US010029709B2

(12) United States Patent
Tateishi et al.

(10) Patent No.: US 10,029,709 B2
(45) Date of Patent: Jul. 24, 2018

(54) RAILCAR

(71) Applicant: KAWASAKI JUKOGYO KABUSHIKI KAISHA, Kobe-shi, Hyogo (JP)

(72) Inventors: Go Tateishi, Kobe (JP); Hiroyuki Kawasaki, Takasago (JP); Hiroyuki Sakurai, Akashi (JP); Ryoji Negi, Kobe (JP); Osamu Muragishi, Kakogawa (JP); Yuji Kamei, Himeji (JP); Shuichi Mizuma, Kobe (JP)

(73) Assignee: KAWASAKI JUKOGYO KABUSHIKI KAISHA, Kobe-shi (JP)

( * ) Notice: Subject to any disclaimer, the term of this patent is extended or adjusted under 35 U.S.C. 154(b) by 141 days.

(21) Appl. No.: 15/036,228

(22) PCT Filed: Nov. 12, 2013

(86) PCT No.: PCT/JP2013/006654

§ 371 (c)(1),
(2) Date: May 12, 2016

(87) PCT Pub. No.: WO2015/071926

PCT Pub. Date: May 21, 2015

(65) Prior Publication Data

US 2016/0297452 A1 Oct. 13, 2016

(51) Int. Cl.
*B61D 17/10* (2006.01)
*B61F 1/08* (2006.01)

(52) U.S. Cl.
CPC ..... *B61D 17/10* (2013.01); *B61F 1/08* (2013.01)

(58) Field of Classification Search
CPC ... B61D 17/10; B61F 1/00; B61F 1/10; B61F 1/12; B61F 1/14
See application file for complete search history.

(56) References Cited

U.S. PATENT DOCUMENTS

2012/0240816 A1* 9/2012 Baumann ..... B61C 17/04 105/422
2013/0213259 A1* 8/2013 Taguchi ..... B61D 17/10 105/422

(Continued)

FOREIGN PATENT DOCUMENTS

JP 2001-026267 A 1/2001
JP 2005-247235 A 9/2005

(Continued)

OTHER PUBLICATIONS

May 17, 2016 International Preliminary Report on Patentability issued in International Patent Application No. PCT/JP2013/006654.

(Continued)

*Primary Examiner* — Jason C Smith
(74) *Attorney, Agent, or Firm* — Oliff PLC

(57) ABSTRACT

A railcar includes: an underframe including a pair of side sills located at both respective ends of the underframe in a car width direction and extending in a car longitudinal direction and a plurality of cross beams coupling the pair of side sills to each other in a car width direction; and an underfloor cover covering an underfloor portion of the underframe. The underfloor cover includes upper and lower plate-shaped members (a shielding plate and a closing plate) made of stainless steel, and the upper and lower plate-shaped members are at least partially spaced apart from each other.

11 Claims, 8 Drawing Sheets

(56) References Cited

U.S. PATENT DOCUMENTS

| | | | | |
|---|---|---|---|---|
| 2013/0220169 | A1* | 8/2013 | Taguchi | B61D 17/10 105/397 |
| 2014/0083321 | A1* | 3/2014 | Kato | B61D 17/10 105/413 |
| 2015/0047530 | A1* | 2/2015 | Hirashima | B61D 17/10 105/413 |
| 2015/0367863 | A1* | 12/2015 | Hirashima | B61D 17/10 105/422 |
| 2016/0297452 | A1* | 10/2016 | Tateishi | B61D 17/10 |
| 2017/0008538 | A1* | 1/2017 | Ackermann | B61D 27/0045 |
| 2017/0028998 | A1* | 2/2017 | Davis | B61D 17/10 |

FOREIGN PATENT DOCUMENTS

| | | | |
|---|---|---|---|
| JP | 2008-013008 | A | 1/2008 |
| JP | 2011-126355 | A | 6/2011 |
| JP | 2012-101597 | A | 5/2012 |
| WO | 2011/042419 | A2 | 4/2011 |
| WO | 2012/063721 | A1 | 5/2012 |

OTHER PUBLICATIONS

Feb. 18, 2014 Search Report issued in International Patent Application No. PCT/JP2013/006654.

* cited by examiner

RAILCAR

TECHNICAL FIELD

The present invention relates to a railcar including an underfloor cover covering an underfloor portion, and more particularly to a fireproof structure of a railcar including an underfloor cover.

BACKGROUND ART

A railcar includes a car bodyshell configured by joining an underframe, side bodyshells, end bodyshells, and a roof bodyshell to one another. Typically, the underframe includes: a pair of side sills extending in a car longitudinal direction (rail direction); and a plurality of cross beams coupling the pair of side sills to each other in a car width direction (sleeper direction). Underfloor devices such as a traction transformer are hung by the cross beams through hanging metal fittings.

Especially in a high-speed car, an underfloor portion of the car is covered with an underfloor cover in some cases. The underfloor cover is provided at a lower portion of the underframe along a side of the car for the purpose of: protecting underfloor devices from obstacles, ice and snow accretions, and the like, the underfloor devices being attached to the underfloor portion of the car; regulating the flow of air around the car; and shaping an appearance of the car. PTL 1 describes the underfloor cover (floor pan) for the high-speed car. This underfloor cover is constituted by: a protective floor supported by an underframe through a frame; and side panels each covering a space between a car width direction end of the protective floor and the underframe.

Regarding the underframe of the railcar, a fireproof standard is set in consideration of underfloor fire. For example, in the United States, fire test specimens and fire test methods are defined in ASTM E-119 Standard Methods of Fire Tests of Building Construction and Materials. This provides relative scales regarding the fire tests. One example of the scales is that the temperature of the fire test specimen that is being heated is lower than a specified temperature for a specified period of time.

PTL 2 describes the underframe of the railcar including the fireproof structure. The cross beams of the underframe are covered with a heat insulating material, and this heat insulating material is covered with a heat protection plate. Further, an entire lower surface of an airtight floor supported by the cross beams is covered with a heat insulating material and a heat protection material.

CITATION LIST

Patent Literature

PTL 1: International Publication No. WO2011/042419
PTL 2: International Publication No. WO2012/063721

SUMMARY OF INVENTION

Technical Problem

Typically, as the types of heat transfer, there are heat conduction, heat transmission, and heat emission (radiation). In the underfloor fire of the railcar, the heat conduction and the radiation are major types of the heat transfer.

In the railcar described in PTL 1, the underfloor cover does not include a fireproof structure. If the underfloor fire occurs in this railcar, the car bodyshell made of an aluminum alloy is exposed to the fire to directly receive radiation heat transfer from the protective plate having high temperature. As a result, especially the temperature of the cross beam located at a lower end of the car bodyshell may rapidly increase, and the car bodyshell may collapse in a short period of time. To avoid such rapid temperature increase of the cross beam, the cross beam may have the fireproof structure described in PTL 2. However, if the cross beam includes the heat insulating material and the heat protection plate, work time and cost increase, and in addition, weight of the car significantly increases. Further, since the cross beam is covered with the heat insulating material and the heat protection plate, underfloor rigging becomes difficult.

The present invention was made under these circumstances, and an object of the present invention is to provide a railcar including an underfloor structure having a fireproof performance.

Solution to Problem

A railcar according to the present invention includes: an underframe including a pair of side sills located at both respective ends of the underframe in a car width direction and extending in a car longitudinal direction and a plurality of cross beams coupling the pair of side sills to each other in the car width direction; at least one underfloor device hung by the cross beams; and an underfloor cover covering an underfloor portion of the underframe, the underfloor cover including upper and lower plate-shaped members made of stainless steel, the upper and lower plate-shaped members being located lower than the underfloor device and being at least partially spaced apart from each other in an upward/downward direction.

According to the railcar configured as above, an air layer is formed between the upper and lower plate-shaped members included in the underfloor cover. Even when the underfloor cover is exposed to high temperature of the underfloor fire, radiation heat from the lower plate-shaped member to the underfloor portion of the car is blocked by the air layer and the upper plate-shaped member. In addition, since the upper and lower plate-shaped members are made of stainless steel, the upper and lower plate-shaped members can secure a structure maintaining property under high temperature of fire. The underfloor cover has such fireproof performance, and the underfloor portion of the railcar is covered with this underfloor cover. With this, even when the underfloor fire occurs, the radiation heat transfer to the car bodyshell can be suppressed, and rapid temperature increase of the car bodyshell can be avoided.

Advantageous Effects of Invention

According to the present invention, even when the underfloor cover is heated from below, the radiation heat from the underfloor cover to the underfloor portion is blocked by the upper plate-shaped member and the air layer formed between the upper and lower plate-shaped members. Since the underfloor portion of the railcar is covered with the underfloor cover having such fireproof performance, the underfloor structure of the railcar can obtain the fireproof performance, and therefore, the fireproof performance of the railcar can be improved.

DESCRIPTION OF EMBODIMENTS

Figure 1:
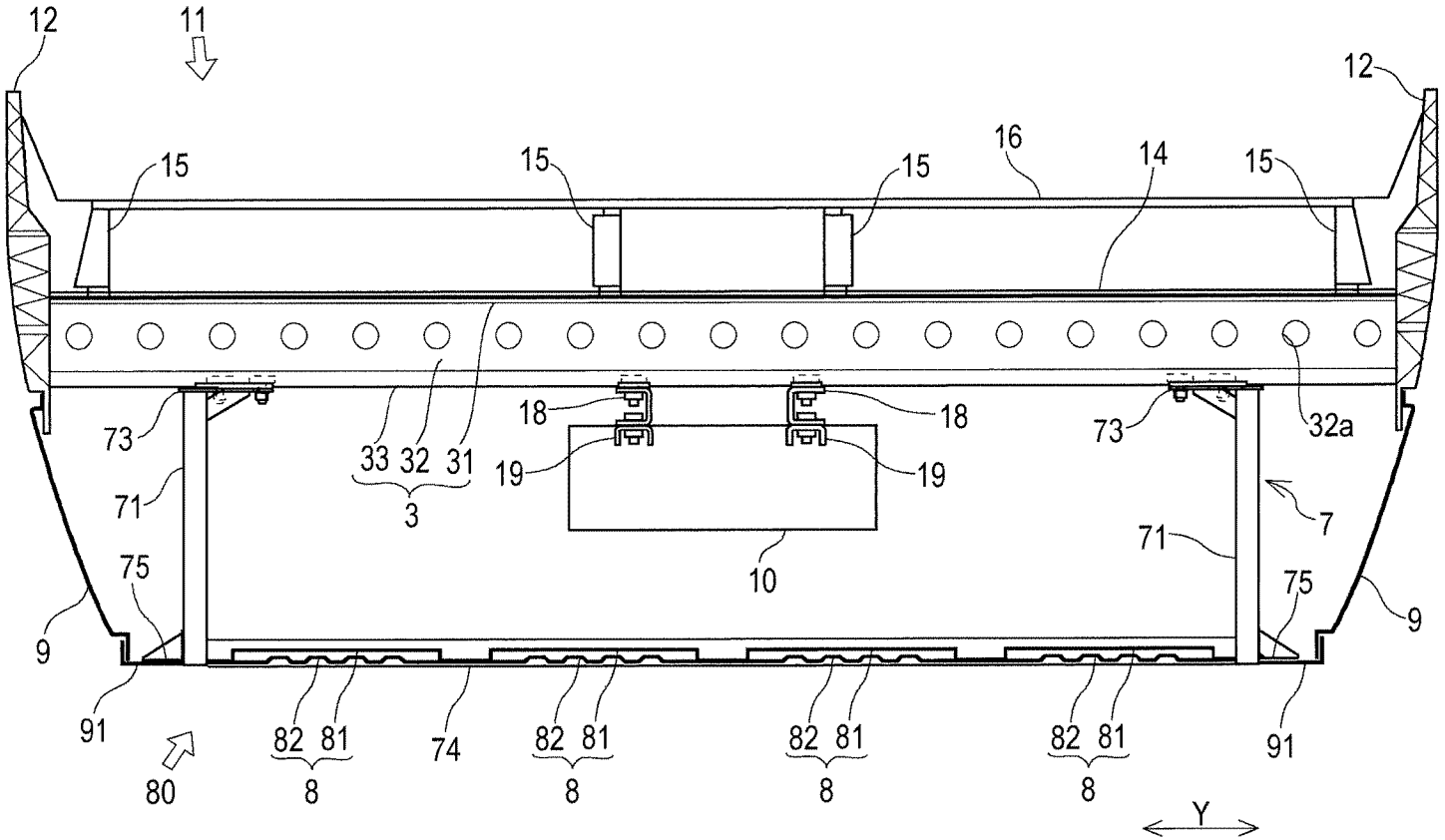
FIG. 1 is a schematic cross-sectional view showing an underframe and underfloor portion of a railcar according to one embodiment of the present invention when viewed from a car width direction.

Hereinafter, an embodiment of the present invention will be explained in reference to the drawings. A railcar according to the present embodiment includes a car bodyshell configured by joining an underframe, side bodyshells, end bodyshells, and a roof bodyshell to one another. FIG. 1 is a schematic cross-sectional view showing the underframe and underfloor portion of the railcar according to one embodiment of the present invention when viewed from a car width direction. As shown in FIG. 1, an underframe 11 provided at a lowermost portion of the car bodyshell includes: a pair of side sills 12 extending in a car longitudinal direction (hereinafter simply referred to as a "longitudinal direction X"); and a plurality of cross beams 3 coupling the pair of side sills 12 to each other in the car width direction (hereinafter simply referred to as a "width direction Y"). The cross beams 3 are provided at a pitch of 600 to 1,000 mm in the longitudinal direction X.

An airtight floor 14 is provided on the underframe 11. A plurality of floor receiving members 15 extending in the longitudinal direction X stand on the airtight floor 14 at intervals in the width direction Y. The floor receiving members 15 support a passenger room floor 16 provided above the airtight floor 14 with a predetermined interval.

A cross section of the cross beam 3 when viewed from the longitudinal direction X has a substantially I shape. A floor supporting portion 31 is formed at an upper portion of the cross beam 3, and a hanging groove portion 33 is formed at a lower portion of the cross beam 3. A web 32 connects the floor supporting portion 31 and the hanging groove portion 33 to each other. The web 32 of the cross beam 3 includes a plurality of piping holes 32*a* through which electric wires, air pipes, and the like are inserted. Head portions of hang-down bolts 18 are inserted in the hanging groove portion 33 of the cross beam 3. An underfloor device 10 is supported by the cross beam 3 through the hang-down bolts 18 and brackets 19 coupled to the hang-down bolts 18.

The underfloor portion of the railcar, that is, a lower side of the underframe 11 is covered with an underfloor cover 80. The underfloor cover 80 includes: a plurality of side covers 9 covering side portions of the underfloor portion of the underframe 11; a plurality of floor covers 8 closing a bottom portion of the underfloor portion of the underframe 11. The underfloor cover 80 is hung and supported by the cross beam 3 through a hanging metal fitting 7. The floor covers 8 are located lower than the underfloor device 10 provided at the underfloor portion of the railcar.

Figure 2:
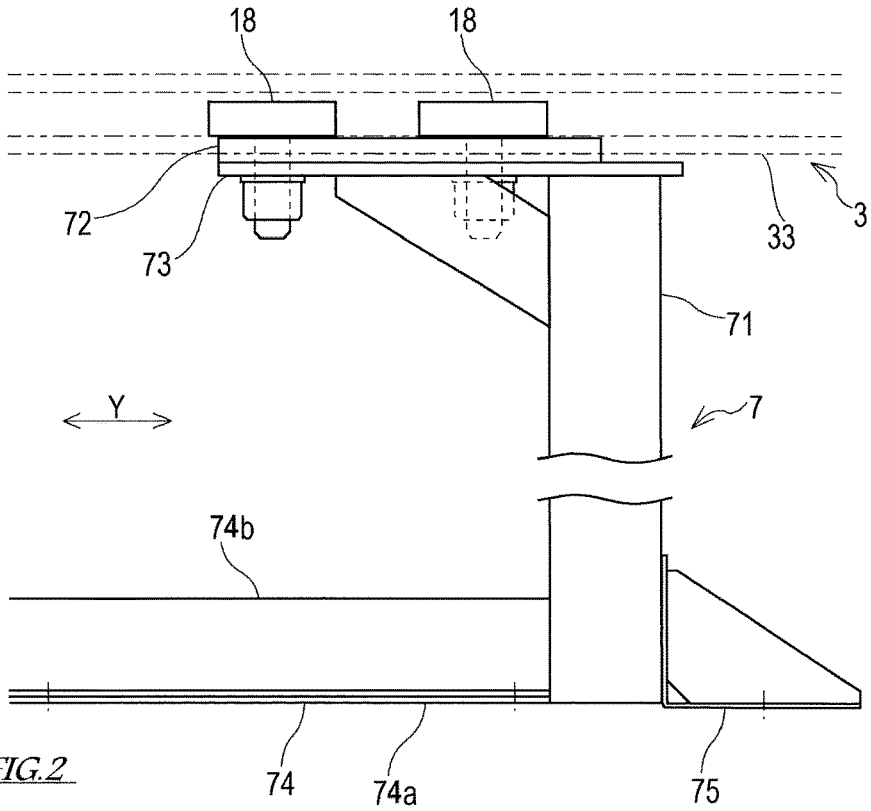
FIG. 2 is a diagram showing a hanging metal fitting when viewed from a car longitudinal direction.
Figure 3:
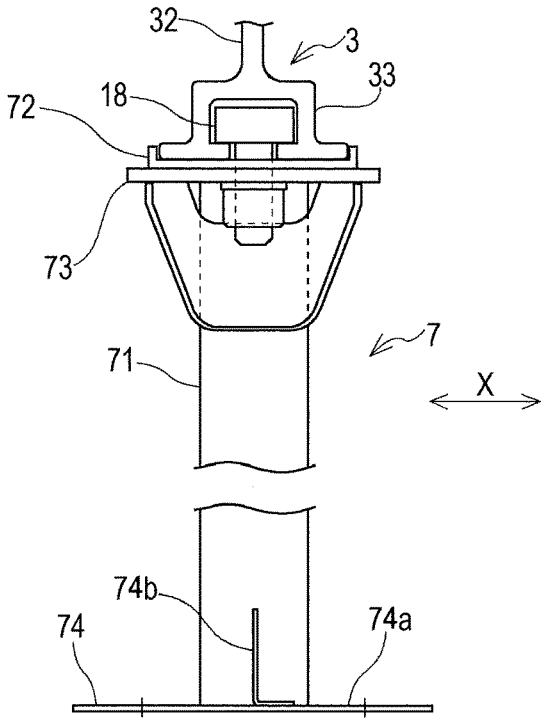
FIG. 3 is a diagram showing the hanging metal fitting when viewed from the car width direction.

FIG. 2 is a diagram showing the hanging metal fitting 7 when viewed from the car longitudinal direction X. FIG. 3 is a diagram showing the hanging metal fitting 7 when viewed from the car width direction Y. FIG. 2 partially shows one width direction Y end portion of the hanging metal fitting 7. As shown in FIGS. 2 and 3, the hanging metal fitting 7 integrally includes: a pair of columnar portions 71 spaced apart from each other in the width direction Y; connecting portions 73 provided at upper end portions of the respective columnar portions 71; a beam portion 74 coupling lower end portions of the pair of columnar portions 71 to each other in the width direction Y; and side supporting portions 75 provided at the lower end portions of the pair of columnar portions 71 so as to be located outside the columnar portions 71 in the width direction Y. When viewed from the longitudinal direction X, the hanging metal fitting 7 has an inverted gate shape.

Each of the connecting portions 73 of the hanging metal fitting 7 has a plate shape. Screw portions of the hang-down bolts 18 each having the head portion inserted into the hanging groove portion 33 of the cross beam 3 are inserted through the connecting portion 73. The hanging groove portion 33 of the cross beam 3 and the connecting portions 73 of the hanging metal fitting 7 are fastened to each other by fastening members including the hang-down bolts 18. An attaching metal receiver 72 is interposed between the hanging groove portion 33 of the cross beam 3 and the connecting portion 73 of the hanging metal fitting 7.

A side plate fixing member 91 is attached to the side supporting portion 75 of the hanging metal fitting 7. The side plate fixing member 91 projects from a lower end of the hanging metal fitting 7 toward an outside in the width direction Y. A width direction Y end portion of the side plate fixing member 91 and a lower end portion of the side cover 9 are coupled to each other. An upper end portion of the side cover 9 is coupled to a lower end portion of the side sill 12. With this, a lower side of the side sill 12 is covered with the side cover 9.

The beam portion 74 of the hanging metal fitting 7 includes: a supporting surface 74*a*; and a reinforcing surface 74*b* substantially orthogonal to the supporting surface 74*a*. Longitudinal direction X end portions of the floor covers 8 are placed on the supporting surface 74*a* of the beam portion 74. As shown by the plan view of the underfloor cover 80 in FIG. 4, the hanging metal fittings 7 are attached to the respective cross beams 3 adjacent to one another in the longitudinal direction X. Each of the floor covers 8 is supported by the cross beams 3 so as to extend between the beam portions 74 of the hanging metal fittings 7 adjacent to each other in the longitudinal direction X.

Figure 5:
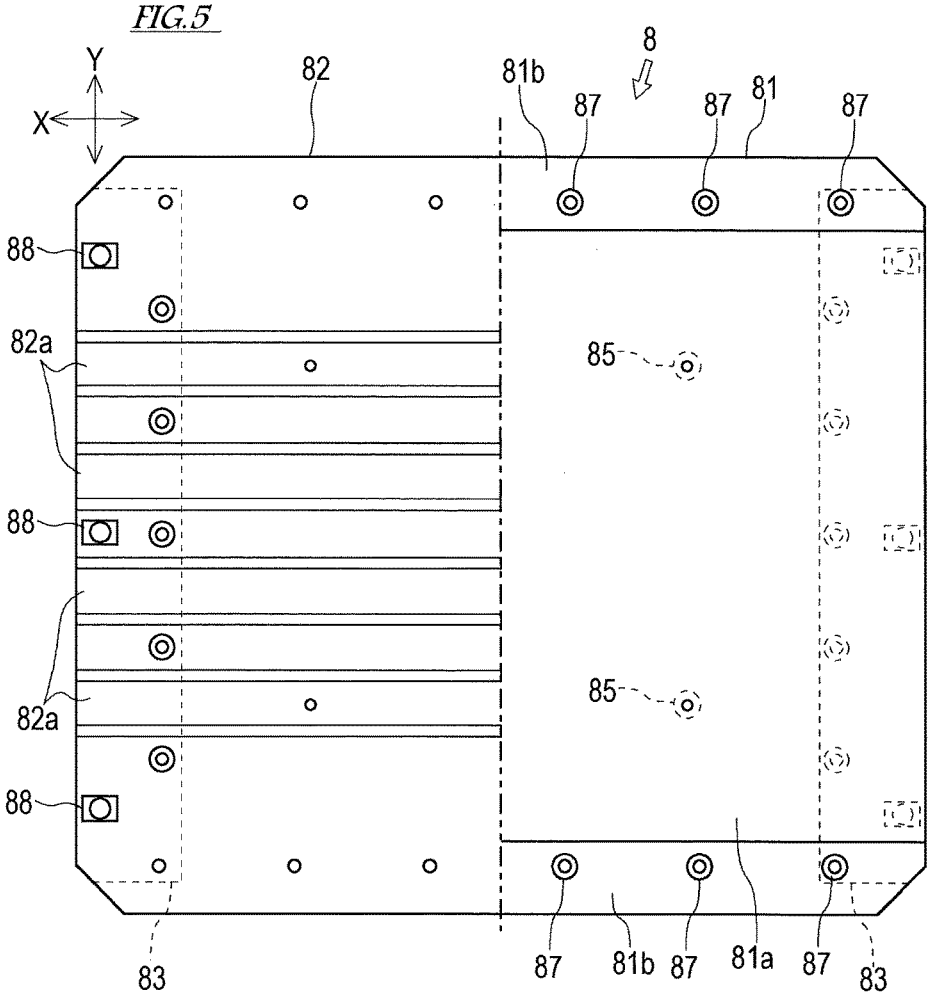
FIG. 5 is a plan view showing an underfloor cover.
Figure 6:
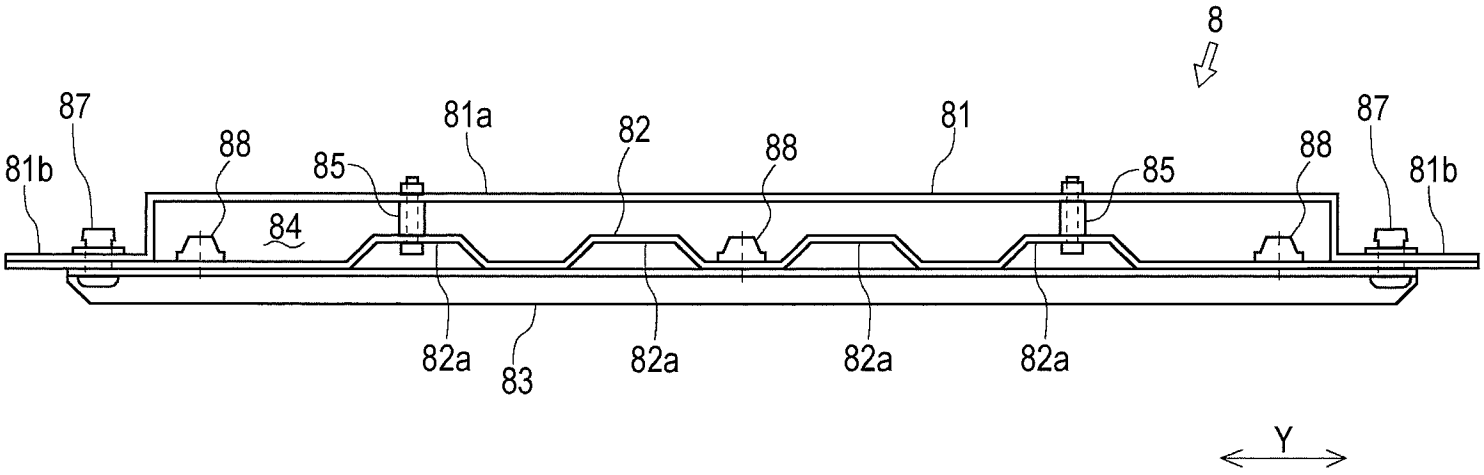
FIG. 6 is a diagram showing the underfloor cover when viewed from the car longitudinal direction.

FIG. 5 is a plan view showing the floor cover 8. FIG. 6 is a diagram showing the floor cover 8 when viewed from the car longitudinal direction X. In FIG. 5, a shielding plate 81 is omitted from a left half of the floor cover 8. As shown in FIGS. 5 and 6, the floor cover 8 includes stainless steel plate-shaped members stacked in an upward/downward direction. The plate-shaped member at an upper side is the shielding plate 81, and the plate-shaped member at a lower side is a closing plate 82.

The closing plate 82 has a substantially rectangular shape in a plan view, and four corners of the closing plate 82 are cut and chamfered. Reinforcing plates 83 are stacked on both respective longitudinal direction X end portions of the closing plate 82 so as to be located under the closing plate 82. The closing plate 82 and the reinforcing plate 83 are fastened to each other by rivets (not shown) at suitable positions. A plurality of projections 82*a* extending in the longitudinal direction X are formed on the closing plate 82 so as to be lined up in the width direction Y.

The shielding plate 81 has a substantially rectangular shape in a plan view. In a plan view, an outer shape of the shielding plate 81 is substantially the same as an outer shape of the closing plate 82. A cross-sectional shape of the shielding plate 81 when viewed from the width direction Y is a hat shape. The shielding plate 81 integrally includes: flange portions 81*b* formed at both respective width direction Y ends; and a shielding portion 81*a* formed between the flange portions 81*b*.

The shielding portion 81*a* of the shielding plate 81 is spaced apart from the closing plate 82 in the upward/downward direction. An air layer 84 as a radiation heat insulating layer is formed between the shielding portion 81*a* and the closing plate 82 that are spaced apart from each other. In the present embodiment, the closing plate 82 and the shielding portion 81*a* of the shielding plate 81 are spaced apart from each other in the upward/downward direction by about 10 to 20 mm at a narrow position and about 20 to 30 mm at a wide position. It should be noted that the distance of separation between the closing plate 82 and the shielding portion 81*a* of the shielding plate 81 is not limited to this.

Stainless steel spacers 85 are provided between the shielding portion 81*a* of the shielding plate 81 and the closing plate 82 so as to maintain the distance between the shielding portion 81*a* of the shielding plate 81 and the closing plate 82. By the spacers 85, the shielding portion 81*a* of the shielding plate 81 and the closing plate 82 are spaced apart from each other and coupled to each other in the upward/downward direction. In the present embodiment, the shielding plate 81 has a thickness of about 1 mm. The plate-shaped member having such thickness may cause problems, such as generation of abnormal noises by vibrations of the plate-shaped member during traveling of the car. However, the spacers 85 are provided between the shielding plate 81 and the closing plate 82, so that even if the floor cover 8 is exposed to high temperature of underfloor fire, the distance of separation between the shielding plate 81 and the closing plate 82 is maintained, and the air layer 84 between the shielding plate 81 and the closing plate 82 is maintained.

The closing plate 82 and the flange portion 81*b* of the shielding plate 81 are coupled to each other in the upward/downward direction by fastening members such as lock bolts. With this, the shielding plate 81 and the closing plate 82 are integrated with each other. Further, the longitudinal direction X end portion of the closing plate 82 is fixed to the beam portion 74 of the hanging metal fitting 7 by fastening members each constituted by a bolt and a screw seat. As above, the floor cover 8 is detachably attached to the hanging metal fitting 7. For example, when performing maintenance of the underfloor device 10, the floor cover 8 is detached from the hanging metal fitting 7.

Figure 4:
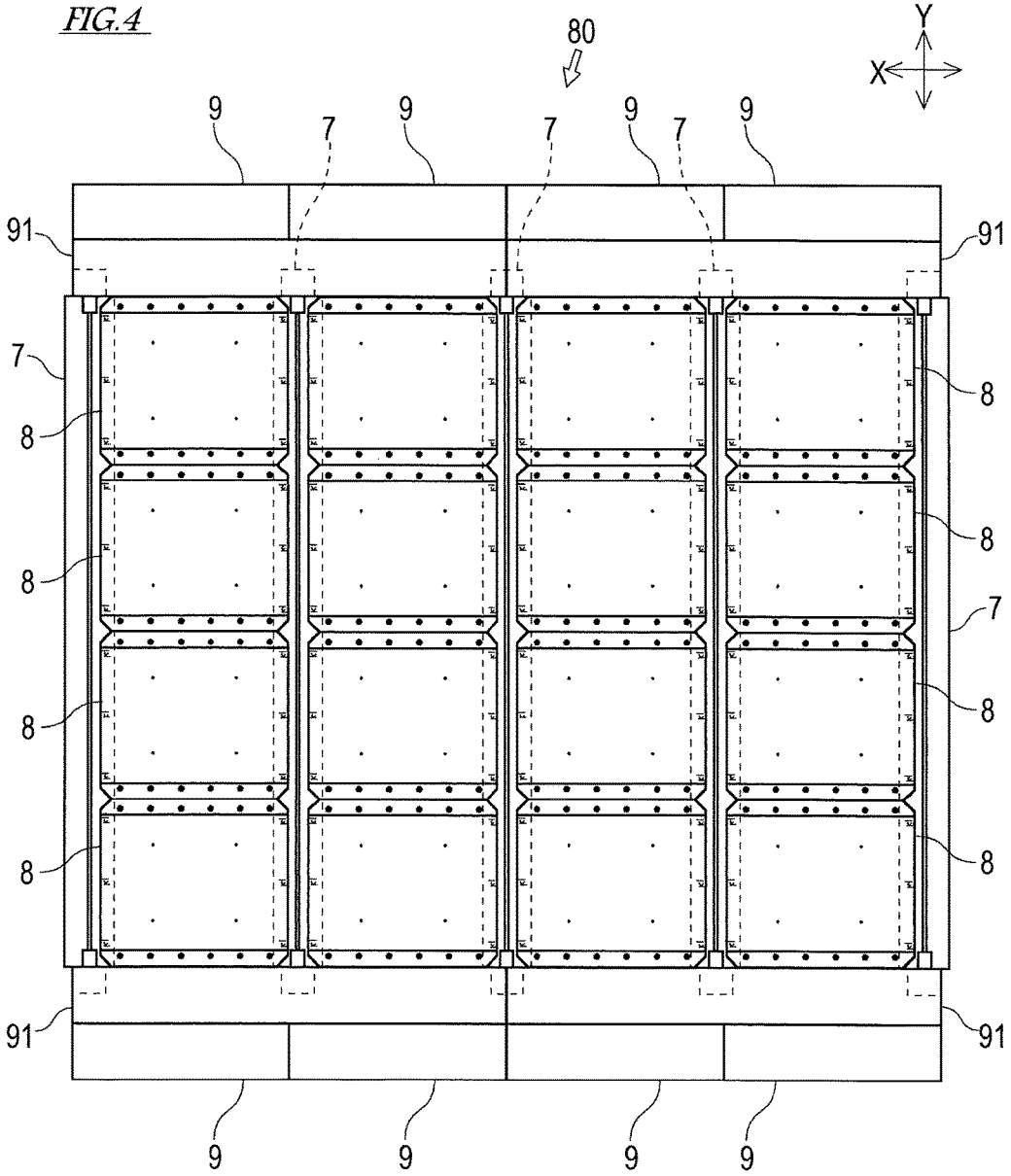
FIG. 4 is a plan view showing an underfloor cover.

As shown in FIG. 4, a plurality of floor covers 8 configured as above are laid all over to form a bottom surface of the underfloor cover 80. Each of the floor covers 8 extends between the hanging metal fittings 7 adjacent to each other in the longitudinal direction X. The four corners of the floor cover 8 are chamfered. The cut of each of the four corners of the floor cover 8 is set to such a size that an opening into which fire flows is not formed at a portion where the floor covers 8 contact each other. Further, although a gap is formed between the floor covers 8 adjacent to each other in the width direction Y, the size of this gap is set to such an adequately small value (about 5 mm, for example) that fire does not flow into this gap.

The attaching of the floor cover 8 is performed by a procedure of: coupling the closing plate 82 and the shielding plate 81 to each other in advance; and attaching the closing plate 82, to which the shielding plate 81 is attached, to the hanging metal fittings 7. It should be noted that the attaching of the floor cover 8 to the underfloor portion may be performed by a procedure of: attaching the closing plate 82 to the hanging metal fitting 7; and then attaching the shielding plate 81 to the closing plate 82.

As explained above, an underfloor structure of the railcar according to the present embodiment includes the underfloor cover 80 covering the underfloor portion of the railcar, that is, the lower side of the underframe 11. The underfloor cover 80 is constituted by: a plurality of floor covers 8 covering the bottom portion of the underfloor portion; and a plurality of side covers 9 covering the side portions of the underfloor portion. The underfloor cover 80 is hung and supported by the cross beams 3 of the underframe 11 through the hanging metal fittings 7. Further, the floor cover 8 includes the upper and lower plate-shaped members (the shielding plate 81 and the closing plate 82) and has a dual structure in which the upper and lower plate-shaped members are at least partially spaced apart from each other. With this, the air layer 84 is formed between the upper and lower plate-shaped members of the floor cover 8. According to the underfloor structure of the railcar configured as above, when the underfloor cover 80 is exposed to high temperature of, for example, the underfloor fire, the radiation heat from the closing plate 82 is blocked by the shielding plate 81. In addition, since both the shielding plate 81 and the closing plate 82 constituting the floor cover 8 are made of stainless steel, the shielding plate 81 and the closing plate 82 can withstand high temperature of the underfloor fire. Since radiation heat transfer to the underfloor portion of the railcar is suppressed as above, the fireproof performance of the railcar is improved. Therefore, even when the underfloor fire of the railcar occurs, rapid temperature increase of the car bodyshell can be avoided, and early collapse of the car bodyshell can be prevented.

The above underfloor structure of the railcar is easily applicable to an existing railcar including an underfloor cover. For example, the shielding plate may be attached to a closing plate forming a bottom surface of the underfloor cover of the existing railcar. With this, an air layer is formed between the closing plate of the underfloor cover and the shielding plate, and the radiation heat transfer to the underfloor portion from the underfloor cover is blocked by the shielding plate 81.

The foregoing has explained a preferred embodiment of the present invention. However, the above configuration may be modified as below, for example.

In the underfloor cover 80 according to the above embodiment, the air layer 84 is interposed between the closing plate 82 and the shielding plate 81 that are spaced apart from each other in the upward/downward direction. However, a heat insulating material layer may be included instead of the air layer 84. In this case, the heat insulating material is interposed between the shielding plate 81 and closing plate 82 of the floor cover 8. With this, the heat insulating material layer is formed between the closing plate 82 and the shielding plate 81, so that even when the floor cover 8 is heated from a lower side by, for example, the underfloor fire, the radiation heat transfer to the underfloor portion from the closing plate 82 can be further effectively reduced. For example, ceramic fiber having heat resistance of 1,000° C. or more can be adopted as the heat insulating material.

For example, the hanging metal fitting 7 according to the above embodiment is made of aluminum alloy for weight reduction. However, to improve the fireproof performance, the hanging metal fitting 7 may be partially or entirely made of stainless steel. If the hanging metal fitting 7 is partially made of stainless steel, the hanging metal fitting 7 may be configured such that: the beam portion 74, the side supporting portions 75, and lower portions of the columnar portions 71 are made of stainless steel; and the connecting portions 73 and upper portions of the columnar portions 71 are made of aluminum alloy. Or, the hanging metal fitting 7 may be configured such that: the beam portion 74 and the side supporting portions 75 are made of stainless steel; and the connecting portions 73 and the columnar portions 71 are made of aluminum alloy. In both cases, the weight reduction of the railcar can be realized, and the hanging metal fitting 7 can obtain the fireproof performance.

Figure 7:
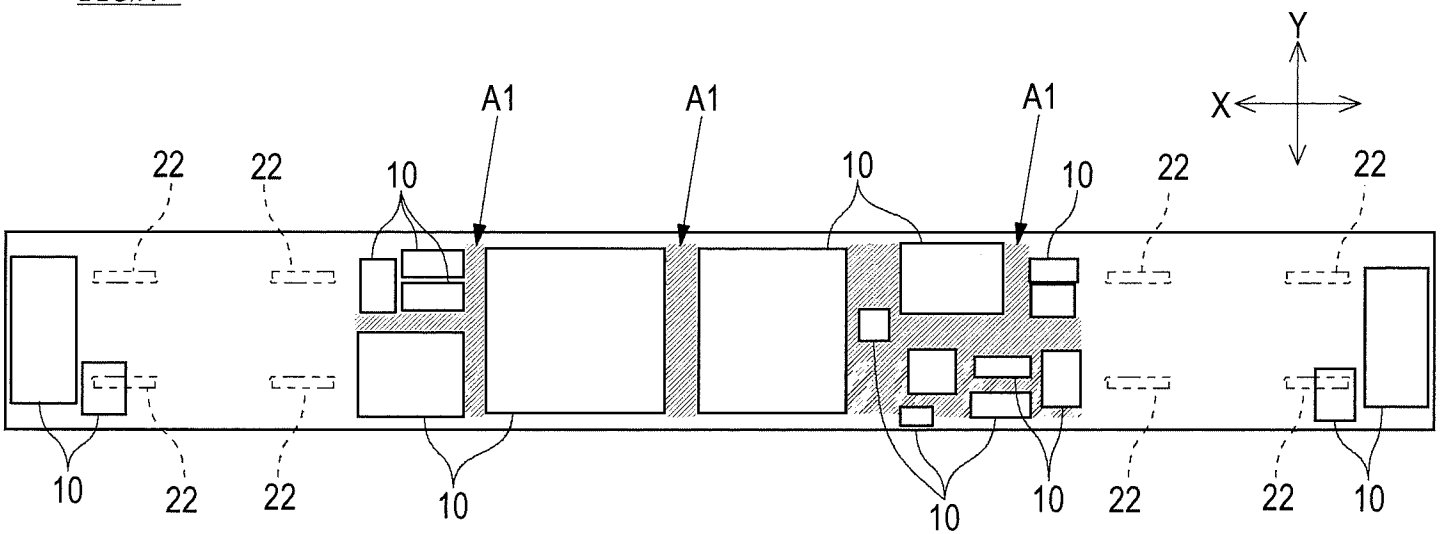
FIG. 7 is a plan view showing an example of arrangement of the underfloor cover and underfloor devices in a car.

In the above embodiment, the floor covers 8 are laid all over on a bottom portion of the underfloor cover 80. However, for example, the floor covers 8 may be selectively provided on the bottom portion of the underfloor cover 80. FIG. 7 is a plan view showing an example of arrangement of the floor covers 8 and the underfloor devices 10 in the car. In FIG. 7, the underfloor devices 10 provided at the underfloor portion of the railcar are shown by squares. Examples of the underfloor devices 10 include a water tank, an electric motor cooling blower, an electromagnetic valve box, an air tank, a brake controller, a main converter, and an air conditioner. Positions of wheels 22 are shown by dotted lines. In the railcar, basically, the underfloor devices 10 are provided so as not to overlap the bogie including the wheels 22 in a plan view, and the underfloor devices 10 are covered with the underfloor cover 80.

Figure 8:
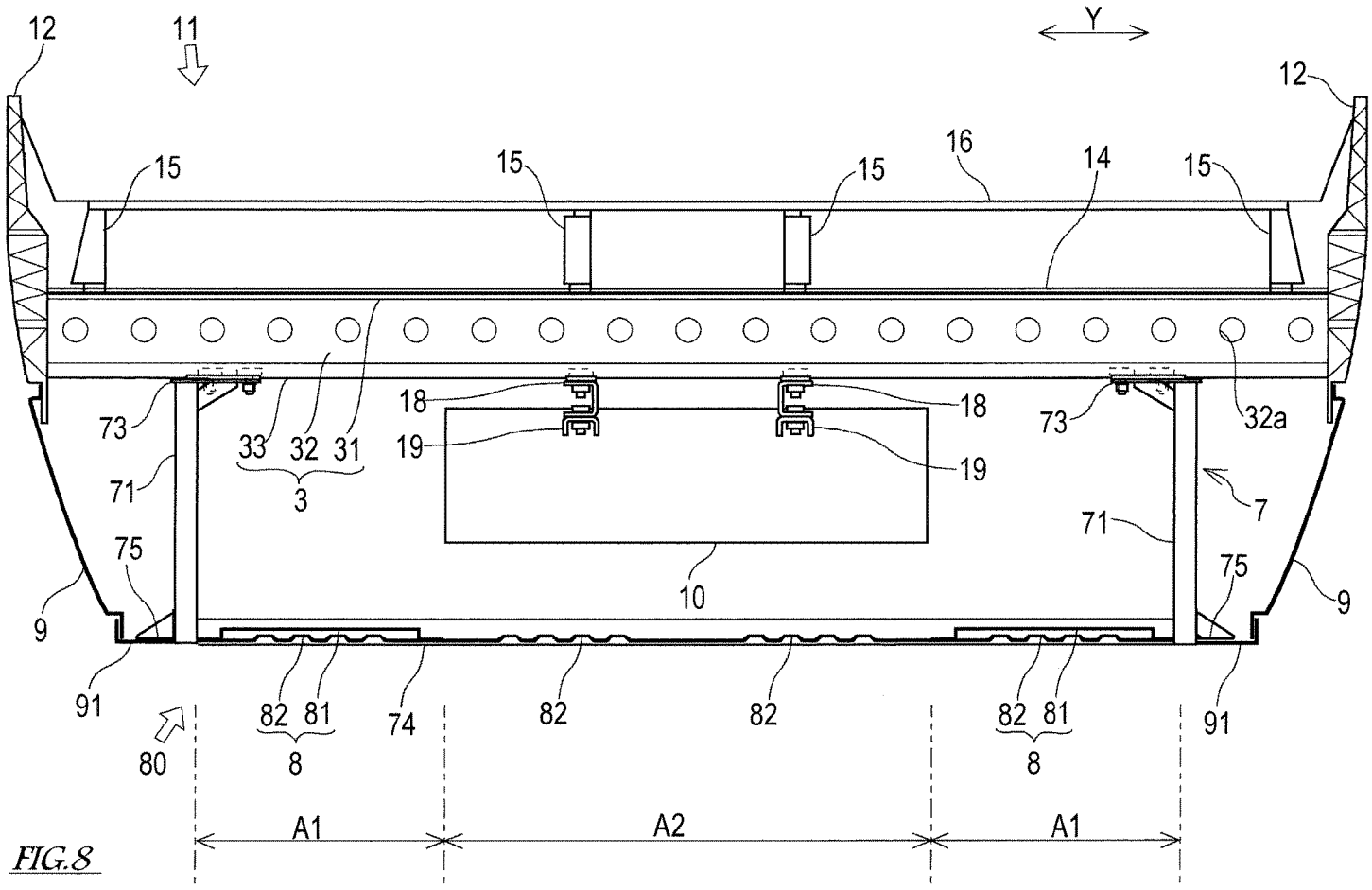
FIG. 8 is a diagram showing floor covers selectively provided at a bottom portion of the underfloor cover.

When the underfloor fire of the railcar occurs, the radiation heat from the underfloor cover 80 is blocked by the underfloor devices 10 in a range of the bottom portion of the underfloor cover 80, the range overlapping the underfloor devices 10 in a plan view. Thus, the radiation heat transfer to the car bodyshell is reduced. Therefore, even if the floor cover 8 having the dual structure constituted by the shielding plate 81 and the closing plate 82 is not provided in the range overlapping the underfloor devices 10 in a plan view, the adequate fireproof performance is realized. As shown in FIG. 8, the closing plates 82 are arranged in a range (A2) of the bottom portion of the underfloor cover 80, the range (A2) overlapping the underfloor devices 10 in a plan view. The floor covers 8 having the dual structure are arranged in a range (A1) (in FIG. 7, a range where diagonal lines are drawn) of the bottom portion of the underfloor cover 80, the range (A1) not overlapping the underfloor devices 10 in a plan view. Since the floor covers 8 having the dual structure are selectively provided at the bottom portion of the underfloor cover 80 as above, the railcar can obtain the fireproof performance with respect to the underfloor fire, and the weight reduction of the car can be realized.

Figure 9:
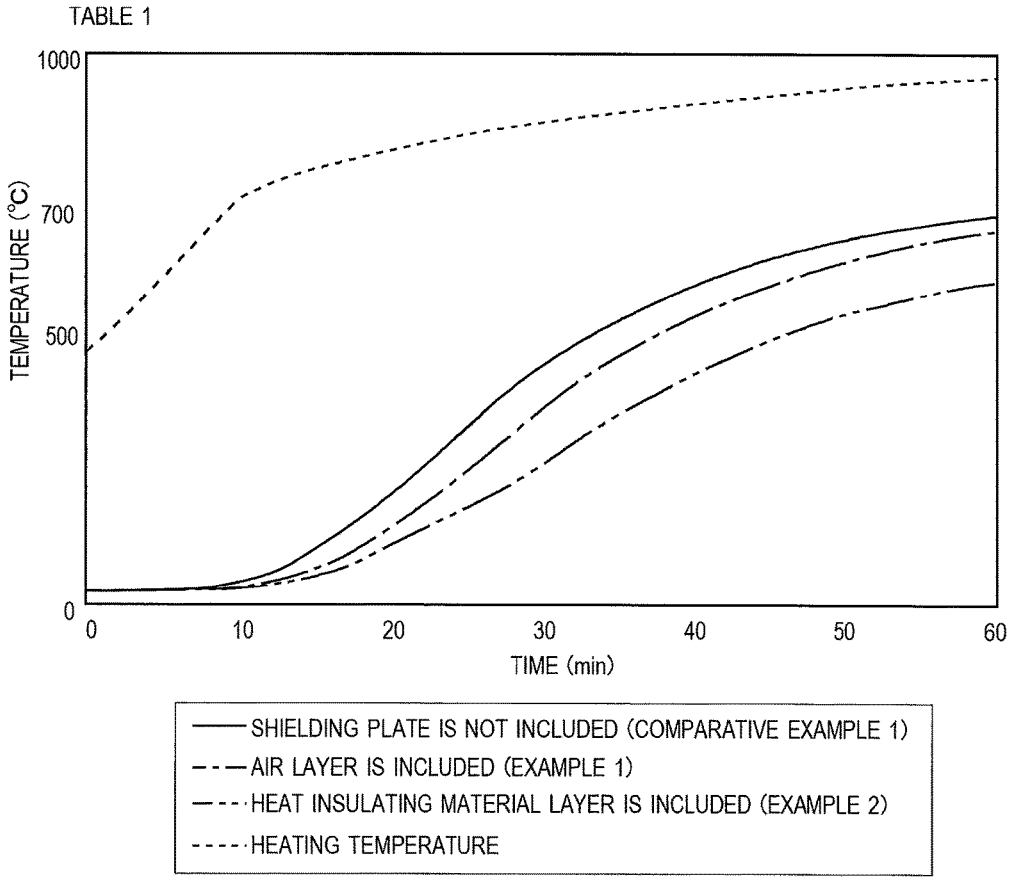
FIG. 9 is a graph showing evaluation results of a fireproof performance of the railcar including the underfloor cover.

The following will explain evaluation results of the fireproof performance of the underfloor structure of the railcar according to the present embodiment. FIG. 9 is a graph 1 showing the evaluation results of the fireproof performance of the railcar including the underfloor cover 80. To evaluate the fireproof performance of the railcar, a simulation model constituted by an underframe and an underfloor structure as shown in FIG. 1 was produced, and a change in maximum temperature point of the cross beam 3 when the underfloor cover 80 was heated from below was calculated by using this simulation model. In the graph 1, a vertical axis shows a temperature, and a horizontal axis shows a heating time. In the graph 1, a dotted line shows a temperature (heating temperature) of a lower surface of the underfloor cover 80. Further, in the graph 1, a one-dot chain line shows the change in maximum temperature point of the cross beam 3 in the underfloor structure (Example 1) in which the bottom portion of the underfloor cover 80 is closed by the floor cover 8 having the dual structure including the air layer as an intermediate layer, and a two-dot chain line shows the change in maximum temperature point of the cross beam 3 in the underfloor structure (Example 2) in which the bottom portion of the underfloor cover 80 is closed by the floor cover 8 having the dual structure including the heat insulating material layer as an intermediate layer. Further, a solid line shows the change in maximum temperature point of the cross beam 3 in the underfloor structure (Comparative Example 1) in which the bottom portion of the underfloor cover 80 is closed only by the closing plate 82.

According to the evaluation results, when the heating temperature is less than about 700° C., the maximum temperature points of the cross beams 3 in Examples 1 and 2 and Comparative Example 1 are almost the same as one another. However, when the measured temperature exceeds 200° C., and the radiation heat becomes dominant, the temperature increase of the maximum temperature point of the cross beam 3 in each of Examples 1 and 2 is made smaller than the temperature increase of the maximum temperature point of the cross beam 3 in Comparative Example 1. To be specific, since the radiation heat is blocked by the floor cover 8 in Examples 1 and 2, the radiation heat transfer to the cross beam 3 in Examples 1 and 2 is smaller than the radiation heat transfer to the cross beam 3 in Comparative Example 1.

The present inventors have confirmed that when the underfloor cover 80 is heated, the temperature of the cross beam 3 becomes higher than the temperature of the airtight floor 14. Therefore, the fireproof performance of the car bodyshell can be evaluated based on the degree of the temperature increase of the cross beam 3. According to the underfloor structure of the railcar of the present embodiment, the temperature increases of the car bodyshell and the airtight floor 14 are suppressed as described above, so that the fireproof performance higher than the conventional fireproof performance can be obtained.

The following will explain results of a fireproof demonstration test of the underfloor structure of the railcar according to the present embodiment. The fireproof demonstration test was performed based on ASTM E119.

A test body of the fireproof demonstration test is constituted by the underframe 11 and the underfloor structure as shown in FIG. 1 and has such a shape that longitudinal direction X intermediate portions of the underframe 11 and the underfloor structure are cut out. The test body has 3,800 mm in the longitudinal direction X, 3,350 mm in the width direction Y, and 1,375 mm in a height direction. Assuming that weights of passengers and seats are applied to an upper surface of the passenger room floor 16 of the test body, a weight of 2,800 kg was mounted on the upper surface of the passenger room floor 16 of the test body. In the fireproof test, the underfloor structure of the test body was placed in a furnace, and the inside of the furnace was heated such that the temperature of a thermocouple provided at a position 305 mm under the lower surface of the cross beam of the test body became a furnace heating temperature condition determined in ASTM E119.

It was confirmed that for 30 minutes from the start of the fireproof demonstration test, (i) each of the degree of the increase in the average temperature of the upper surface of the passenger room floor 16 and the degree of the increase in the maximum temperature of the upper surface of the passenger room floor 16 was not more than a predetermined temperature, (ii) the structure did not collapse, (iii) a cotton pad placed on the passenger room floor 16 did not ignite by, for example, smoke emitted from the test body, (iv) fire did not penetrate through the piping hole 32*a* of the cross beam 3 of the test body or the upper surface of the passenger room floor 16, and (v) the maximum temperature point of the cross beam 3 was not more than a predetermined temperature. To be specific, it was found that the railcar according to the present embodiment has the fireproof performance that is adequate based on ASTM E119.

INDUSTRIAL APPLICABILITY

Since the railcar can obtain the fireproof performance with respect to the underfloor fire, the present invention has a high industrial value.

REFERENCE SIGNS LIST

3 cross beam
7 hanging metal fitting
8 floor cover
81 shielding plate
82 closing plate
9 side cover
10 underfloor device
11 underframe
12 side sill
14 airtight floor
16 passenger room floor
18 hang-down bolt
80 underfloor cover

The invention claimed is:

1. A railcar comprising:
an underframe including
a pair of side sills located at both respective ends of the underframe in a car width direction and extending in a car longitudinal direction and
a plurality of cross beams coupling the pair of side sills to each other in the car width direction;
at least one underfloor device hung by the cross beams; and
an underfloor cover covering an underfloor portion of the underframe and including upper and lower plate-shaped members made of stainless steel, the upper and lower plate-shaped members being located lower than the underfloor device and being at least partially spaced apart from each other in an upward/downward direction,
the upper and lower plate-shaped members are provided in a range of a bottom portion of the underfloor cover, the range not overlapping the underfloor device in a plan view.

2. The railcar according to claim 1, wherein the underfloor cover includes a heat insulating material provided between the upper and lower plate-shaped members.

3. The railcar according to claim 1, wherein the underfloor cover includes a spacer provided between the upper and lower plate-shaped members and configured to maintain a distance of separation between the upper and lower plate-shaped members.

4. The railcar according to claim 1, further comprising a hanging metal fitting including
a pair of post portions made of aluminum alloy and
a beam portion made of stainless steel and coupling lower end portions of the pair of post portions to each other in the car width direction,
upper portions of the pair of post portions being coupled to the cross beam, and the beam portion being coupled to the underfloor cover.

5. The railcar according to claim 1, further comprising a hanging metal fitting including
a pair of post portions each including an upper portion made of aluminum alloy and a lower portion made of stainless steel and
a beam portion made of stainless steel and coupling lower end portions of the pair of post portions to each other in the car width direction,
the upper portions of the pair of post portions being coupled to the cross beam, and the beam portion being coupled to the underfloor cover.

6. A railcar comprising:
an underframe including
a pair of side sills located at both respective ends of the underframe in a car width direction and extending in a car longitudinal direction and
a plurality of cross beams coupling the pair of side sills to each other in the car width direction;
at least one underfloor device hung by the cross beams;
an underfloor cover covering an underfloor portion of the underframe and including upper and lower plate-shaped members made of stainless steel, the upper and lower plate-shaped members being located lower than the underfloor device and being at least partially spaced apart from each other in an upward/downward direction; and
a hanging metal fitting including
a pair of post portions made of aluminum alloy and
a beam portion made of stainless steel and coupling lower end portions of the pair of post portions to each other in the car width direction,
upper portions of the pair of post portions being coupled to the cross beam, and the beam portion being coupled to the underfloor cover.

7. The railcar according to claim 6, wherein the underfloor cover includes a heat insulating material provided between the upper and lower plate-shaped members.

8. The railcar according to claim 6, wherein the underfloor cover includes a spacer provided between the upper and lower plate-shaped members and configured to maintain a distance of separation between the upper and lower plate-shaped members.

9. A railcar comprising:
an underframe including
a pair of side sills located at both respective ends of the underframe in a car width direction and extending in a car longitudinal direction and
a plurality of cross beams coupling the pair of side sills to each other in the car width direction;
at least one underfloor device hung by the cross beams; and
an underfloor cover covering an underfloor portion of the underframe and including upper and lower plate-shaped members made of stainless steel, the upper and lower plate-shaped members being located lower than the underfloor device and being at least partially spaced apart from each other in an upward/downward direction; and a hanging metal fitting including a pair of post portions each including an upper portion made of aluminum alloy and a lower portion made of stainless steel and a beam portion made of stainless steel and coupling lower end portions of the pair of post portions to each other in the car width direction, the upper portions of the pair of post portions being coupled to the cross beam, and the beam portion being coupled to the underfloor cover.

10. The railcar according to claim 9, wherein the underfloor cover includes a heat insulating material provided between the upper and lower plate-shaped members.

11. The railcar according to claim 9, wherein the underfloor cover includes a spacer provided between the upper and lower plate-shaped members and configured to maintain a distance of separation between the upper and lower plate-shaped members.

* * * * *